US008262198B2

(12) United States Patent
Ishii et al.

(10) Patent No.: US 8,262,198 B2
(45) Date of Patent: Sep. 11, 2012

(54) HEAD ATTACHMENT MEMBER, LIQUID EJECTION DEVICE, AND HEAD ATTACHMENT METHOD

(75) Inventors: Hiroyuki Ishii, Nagano (JP); Hiroyuki Hagiwara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 13/013,950

(22) Filed: Jan. 26, 2011

(65) Prior Publication Data

US 2011/0187793 A1 Aug. 4, 2011

(30) Foreign Application Priority Data

Feb. 2, 2010 (JP) ..... 2010-021685

(51) Int. Cl.
*B41J 2/15* (2006.01)
*B41J 2/145* (2006.01)

(52) U.S. Cl. ..... 347/40; 347/8; 347/20

(58) Field of Classification Search ..... 347/8, 16, 347/40, 42, 49, 104
See application file for complete search history.

(56) References Cited

U.S. PATENT DOCUMENTS 6,123,472 A 9/2000 Elgee
6,154,232 A * 11/2000 Hickman et al. ..... 347/40
6,913,341 B2 7/2005 Barinaga et al.

FOREIGN PATENT DOCUMENTS

JP 2000-289279 A 10/2000
JP 2005-053227 A 3/2005

* cited by examiner

*Primary Examiner* — Thinh Nguyen
(74) *Attorney, Agent, or Firm* — Global IP Counselors, LLP

(57) ABSTRACT

A plurality of liquid ejection heads is attached to a head attachment member. The head attachment member is disposed so as to face a support drum for supporting an ejection-receiving medium and rotating about a shaft. The head attachment member includes a pair of plate-shaped members each having an attachment surface to which a plurality of head groups each including the liquid ejection heads is attached and a back surface extending parallel to the attachment surface. End parts of the plate-shaped members are connected to each other so as to be able to rotate about a hinge part so that an angle formed by the attachment surfaces is adjustable.

7 Claims, 7 Drawing Sheets

HEAD ATTACHMENT MEMBER, LIQUID EJECTION DEVICE, AND HEAD ATTACHMENT METHOD

CROSS-REFERENCE TO RELATED APPLICATIONS

This application claims priority to Japanese Patent Application No. 2010-021685 filed on Feb. 2, 2010. The entire disclosure of Japanese Patent Application No. 2010-021685 is hereby incorporated herein by reference.

BACKGROUND

1. Technical Field

The present invention relates to a head attachment member, a liquid ejection device, and a head attachment method, and is particularly useful for application to a liquid ejection device in which a liquid ejection head is attached so as to face a rotating support drum.

2. Related Art

Known liquid ejection devices for ejecting a liquid to an ejection-receiving medium include inkjet recording devices, for example, for ejecting ink as the liquid to print on a paper, recording sheet, or other ejection-receiving medium.

Liquid ejection devices have been proposed in which an ejection-receiving medium is wound onto the periphery of a drum which rotates about a shaft, and printing is applied to the ejection-receiving medium by an inkjet recording head provided on the periphery of the drum, for example (see Japanese Laid-Open Patent Publication No. 2005-53227 and Japanese Laid-Open Patent Publication No. 2000-289279, for example).

Japanese Laid-Open Patent Publication No. 2005-53227 discloses a liquid ejection device in which a printing bar, to which a plurality of liquid ejection heads is fixed, is fixed to a printing bar frame structure.

Japanese Laid-Open Patent Publication No. 2000-289279 (p. 4, FIG. 3) discloses a liquid ejection device having a print cartridge carrying table fixed in relation to a drum, wherein the print cartridge carrying table is configured so that a print cartridge in which a liquid ejection head is fixed to the bottom surface thereof is fitted and attached to two frame members and carrying table constituent elements which are fixed to four flat parts provided on the frame members.

SUMMARY

However, in a case in which a plurality of liquid ejection heads is radially arranged in the peripheral direction of a support drum, as in Japanese Laid-Open Patent Publication No. 2005-53227, since a printing bar in which a plurality of liquid ejection heads is attached as in Japanese Laid-Open Patent Publication No. 2005-53227 must be attached to the printing bar frame structure at different angles with respect to the support drum, each printing bar must be positioned with respect to the drum, which involves a complex operation, and problems arise in that highly precise positioning is difficult to achieve, and the attachment direction and the distances to the drum are no longer uniform.

The technique of Japanese Laid-Open Patent Publication No. 2000-289279 also has drawbacks in that the relative angles of the four flat parts are difficult to form with high precision with respect to the drum, positioning the liquid ejection heads in each of the four flat parts for attachment with respect to the drum is a complex operation, highly precise positioning is difficult to achieve, and the attachment direction and the distances to the drum are no longer uniform.

On the other hand, in the case of a liquid ejection device in which the ejection-receiving medium is wound onto the periphery of a drum which rotates about a shaft, and printing is applied to the ejection-receiving medium by inkjet recording heads provided on the periphery of the drum, surfaces parallel to the directions of lines tangent to various points on the drum must necessarily be a plurality of inclined surfaces, but it is difficult to increase precision of the positioning of the liquid ejection heads on inclined surfaces in predetermined positions.

Furthermore, it is complicated to manufacture a different head attachment member for each liquid ejection device provided with a rotating drum of a different diameter.

In view of the foregoing, an object of the present invention is to provide a head attachment member, a liquid ejection device, and a head attachment method whereby a liquid ejection head can easily be positioned in a predetermined position with high precision.

One aspect of the present invention for achieving the abovementioned objects is a head attachment member in which a plurality of liquid ejection heads is attached, the head attachment member being disposed so as to face a support drum for supporting an ejection-receiving medium and rotating about a shaft. The head attachment member includes a pair of plate-shaped members each having an attachment surface to which a plurality of head groups each including the liquid ejection heads is attached and a back surface extending parallel to the attachment surface, end parts of the plate-shaped members being connected to each other so as to be able to rotate about a hinge part so that an angle formed by the attachment surfaces is adjustable.

According to this aspect, since the angle formed by adjacent attachment surfaces is adjustable, one head attachment member can be used in common for a plurality of support drums having different diameters, without manufacturing a head attachment member for each different diameter of support drum.

It is preferred that a locking mechanism be provided that is configured to lock the angle between the attachment surfaces at an angle at which each of the attachment surfaces is parallel to a line tangent to a peripheral surface of the support drum at an intersection point of the peripheral surface of the support drum with a line segment formed by connecting a center of the support drum and a center between the head groups adjacent in a rotation direction of the support drum and attached to the plate-shaped member.

In this case, since positioning of the head attachment member with respect to the support drum in the manner described above is performed in a state in which alignment of the liquid ejection heads with respect to the head attachment unit is completed, the positioning of the liquid ejection heads and the support drum, particularly, the distances between the distal end surfaces of the liquid ejection heads and the peripheral surface of the support drum, can be made uniform without separately positioning each liquid ejection head with respect to the support drum, and the liquid ejection heads can be reliably fixed in predetermined positions with respect to the support drum in this state. This configuration can therefore contribute to enhanced printing quality.

Another aspect of the present invention resides in a liquid ejection device comprising the head attachment member described above, the liquid ejection heads attached to the attachment surfaces of the head attachment member, and the support drum configured to support the ejection-receiving medium.

According to this aspect, the positioning of the liquid ejection heads and the support drum, particularly, the distances between the distal end surfaces of the liquid ejection heads and the peripheral surface of the support drum, can be made uniform merely by fixing the liquid ejection heads via the head attachment member, without separately positioning each liquid ejection head with respect to the support drum.

The liquid ejection heads for ejecting the same type of liquid are preferably attached to each of the attachment surfaces. Since the relative positioning of head groups provided to the same head attachment member can be accomplished with high precision, a high printing resolution can be obtained.

Another aspect of the present invention resides in a head attachment method for placing a head attachment member, to which a plurality of liquid ejection heads is attached, with respect to a support drum for supporting an ejection-receiving medium and rotating about a shaft, the head attachment member including a pair of plate-shaped members each having an attachment surface to which a plurality of head groups each including the liquid ejection heads is attached and a back surface extending parallel to the attachment surface with end parts of the plate-shaped members being connected to each other so as to be able to rotate about a hinge part so that an angle formed by the attachment surfaces is adjustable. The head attachment method includes: retaining the head attachment member so that the back surfaces are in contact with a horizontal surface and the attachment surfaces are horizontal; placing/fixing the liquid ejection heads in alignment with respect to the head attachment member while moving an imaging unit of an alignment device horizontally above the head attachment member; and rotating the plate-shaped members about the hinge part and adjusting the angle formed by the attachment surfaces so that each of the attachment surfaces is parallel to a line tangent to a peripheral surface of the support drum at an intersection point of the peripheral surface of the support drum with a line segment formed by connecting a center of the support drum and a center between the head groups adjacent in the rotation direction of the support drum attached to the plate-shaped member, and subsequently fixing the head attachment member with respect to the support drum.

According to this aspect, since alignment of the liquid ejection heads with respect to the head attachment member is performed in a state in which the head attachment member is kept horizontal, the imaging unit of the alignment device need only move in the horizontal plane, and movement in the vertical direction is not included. Error can therefore be reduced by a corresponding degree, and highly precise alignment is possible. In this state, the angle formed by the plate-shaped members is adjusted to a predetermined value by rotating the plate-shaped members via the hinge part, and the head attachment member is fixed in this state so as to maintain a predetermined positional relationship with respect to the support drum. The positioning of the liquid ejection heads and the support drum, particularly, the distances between the distal end surfaces of the liquid ejection heads and the peripheral surface of the support drum, can therefore be made uniform without separately positioning each liquid ejection head with respect to the support drum. This configuration can therefore contribute to enhanced printing quality.

Incidentally, in the case of aligning the liquid ejection heads in the head attachment member in which the attachment surfaces are inclined, the need arises for the imaging unit of the alignment device to move not only in the horizontal direction but in the vertical direction as well, which introduces a corresponding amount of movement error, and not only is an increase in the precision of alignment inhibited, but in the case of fabricating a glass mask having an inclined shape, the glass mask is also difficult to fabricate.

BRIEF DESCRIPTION OF THE DRAWINGS

Referring now to the attached drawings which form a part of this original disclosure.

DETAILED DESCRIPTION OF EXEMPLARY EMBODIMENTS

The present invention will be described in detail based on embodiments.

Figure 1:
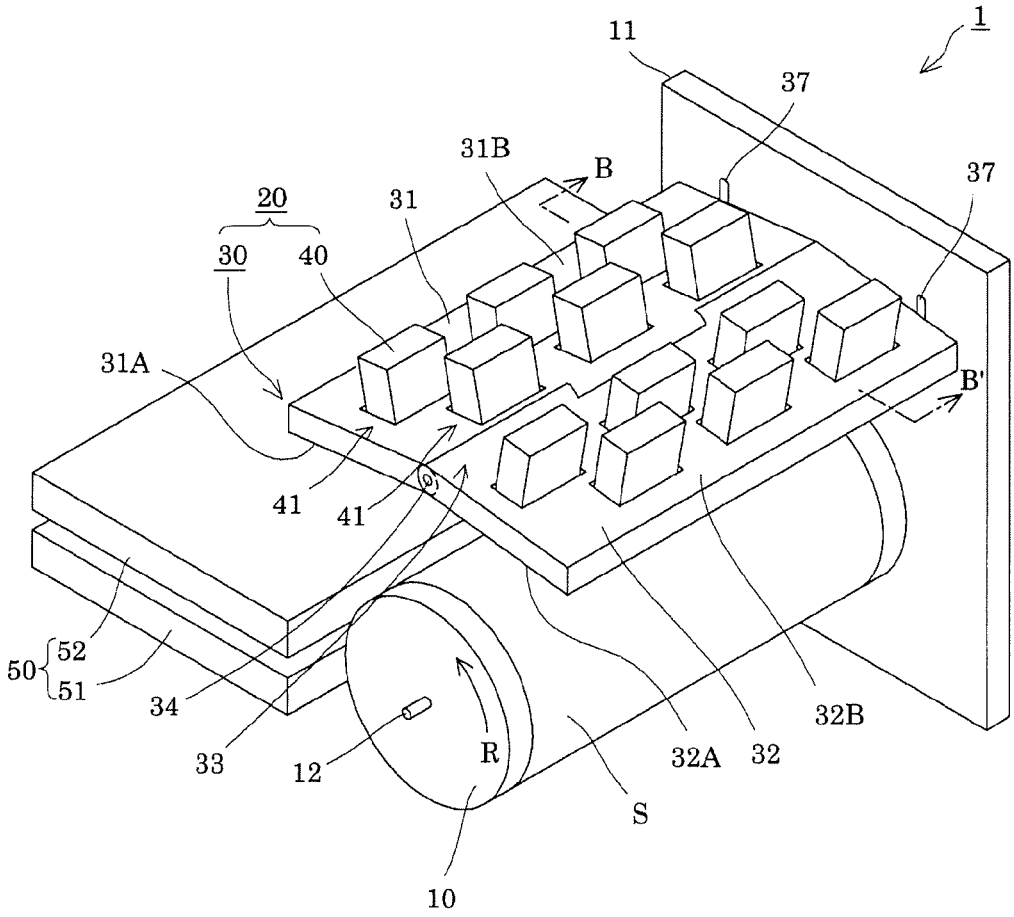
FIG. 1 is an overall perspective view showing the liquid ejection device according to an embodiment.
Figure 2:
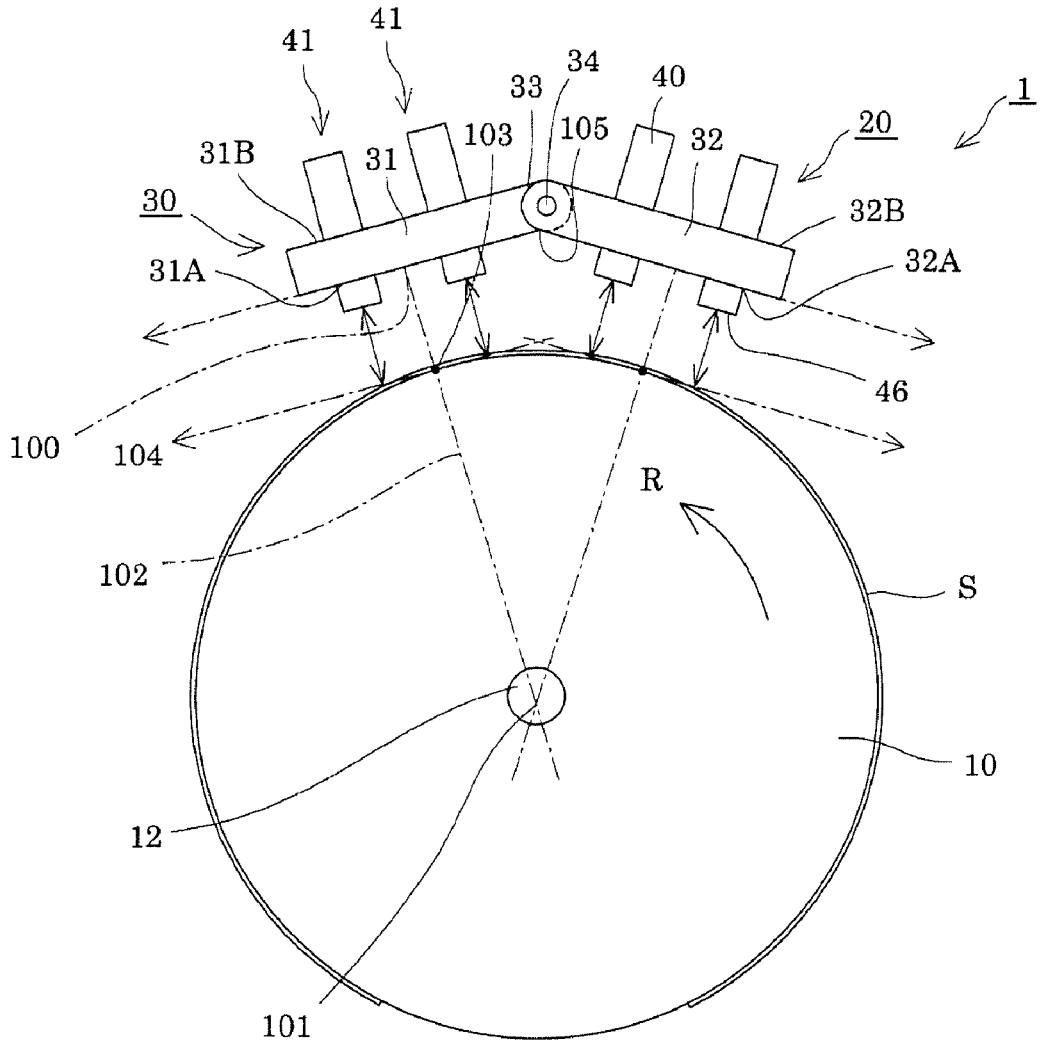
FIG. 2 is a side view showing the relevant parts of the liquid ejection device according to an embodiment.

FIG. 1 is an overall perspective view showing the liquid ejection device according to an embodiment of the present invention, and FIG. 2 is a side view showing the relevant parts of the liquid ejection device. As shown in the drawings, the liquid ejection device 1 of the present embodiment is provided with a drum-shaped support drum 10, a liquid ejection head unit 20 provided on the external periphery of the support drum 10, and a conveyance means 50 which has a feeding part 51 for feeding an ejection-receiving medium S to the support drum 10 and a removal part 52 for removing the ejection-receiving medium S from the support drum 10.

The support drum 10 has a rotation shaft 12 supported by a frame 11, and the support drum 10 rotates about the rotation shaft 12 in the direction of the arrow R shown in FIG. 1. Such rotation of the support drum 10 is performed by a drive motor or other drive means not shown in the drawings.

The support drum 10 retains the ejection-receiving medium S on the peripheral surface thereof. The method whereby the support drum 10 retains the ejection-receiving medium S is not particularly limited, and the ejection-receiving medium S may be attached to the surface of the support drum 10 by suction, for example. As an example of another retaining method, the external peripheral surface of the ejection-receiving medium S may be electrically charged, and the ejection-receiving medium S may be attached to the support drum 10 by the action of induced polarization. Of course, a configuration may also be adopted in which a presser roller or the like is provided for holding the ejection-receiving medium S against the surface of the support drum 10.

The liquid ejection head unit 20 is provided with a head attachment member 30 and a plurality of liquid ejection heads 40 which is fixed to the head attachment member 30.

Figure 3:
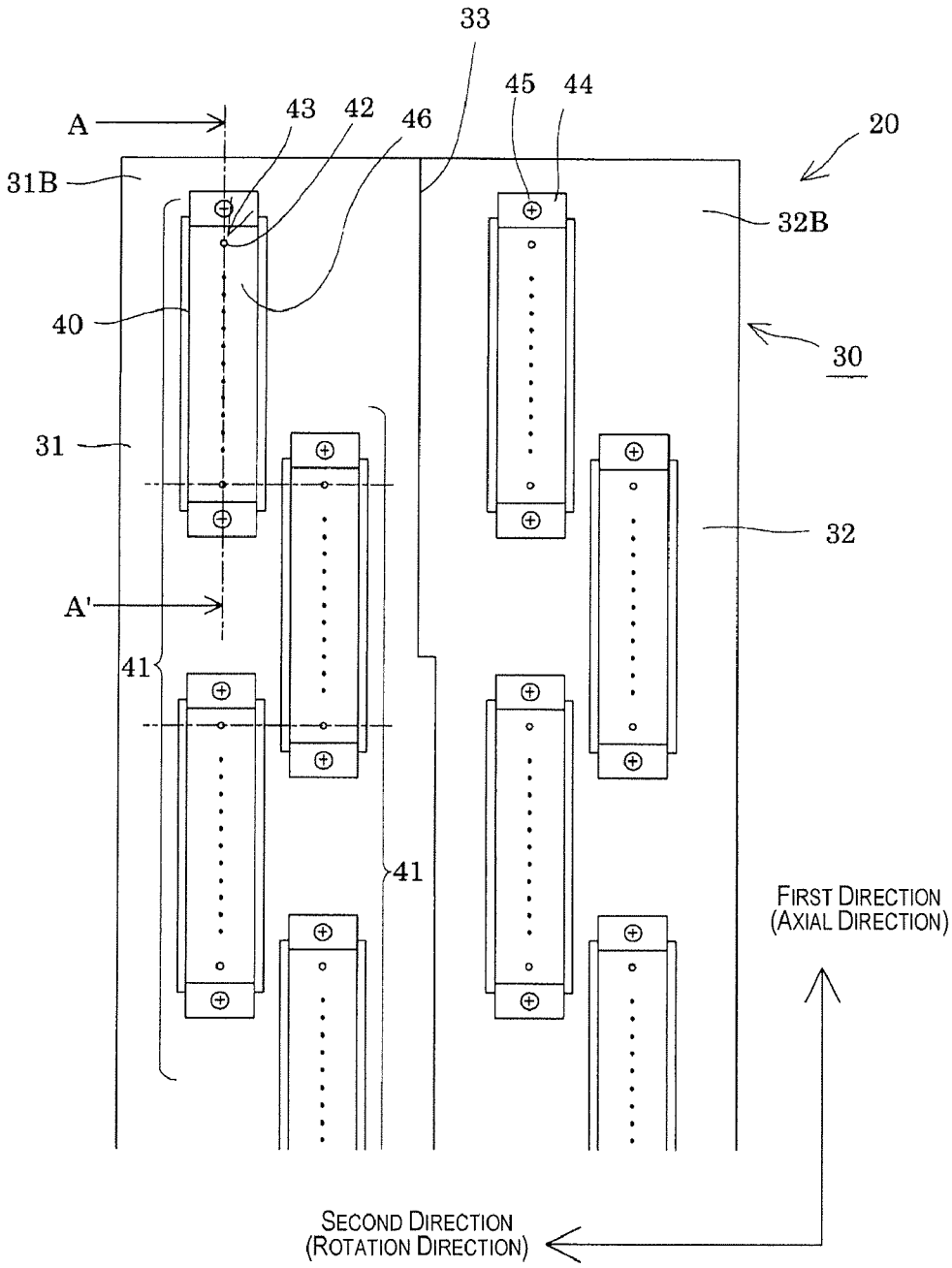
FIG. 3 is a plan view showing the liquid ejection head unit according to an embodiment.
Figure 4:
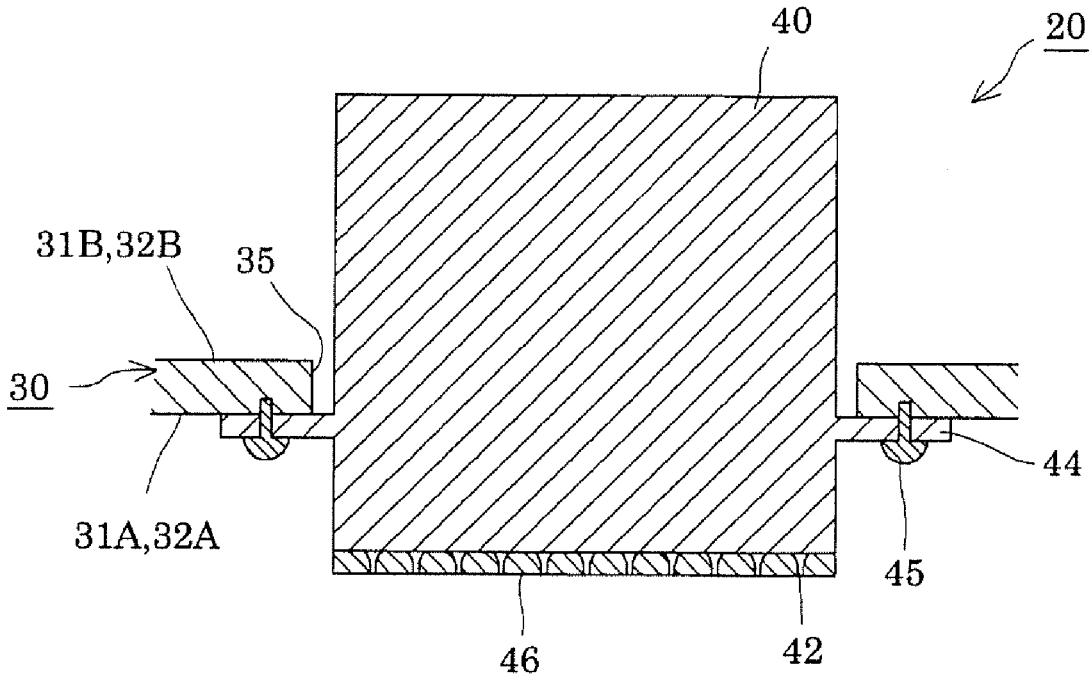
FIG. 4 is a sectional view along line A-A' of FIG. 3.
Figure 5:
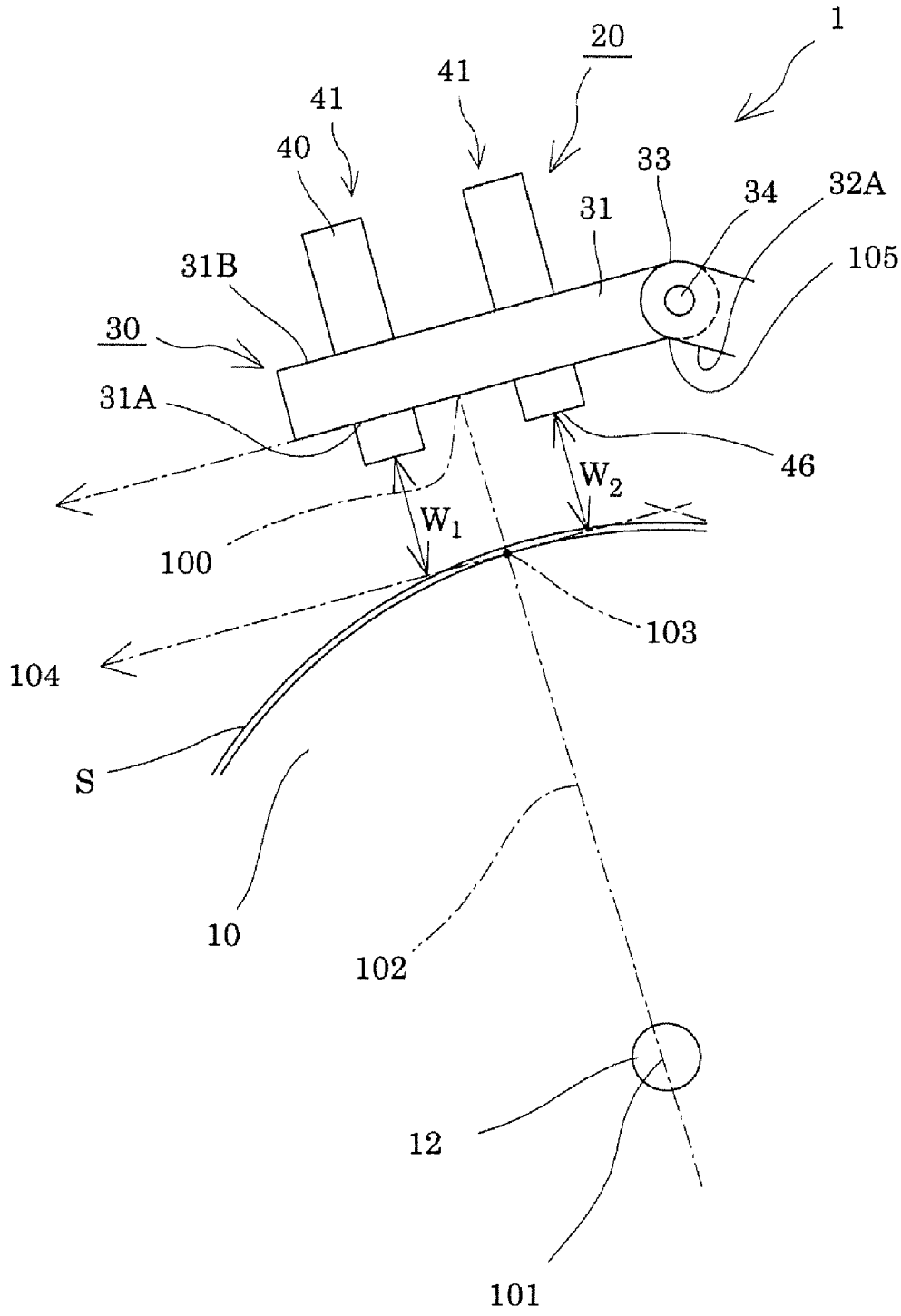
FIG. 5 is an enlarged side view showing the relevant parts of FIG. 2.
Figure 6:
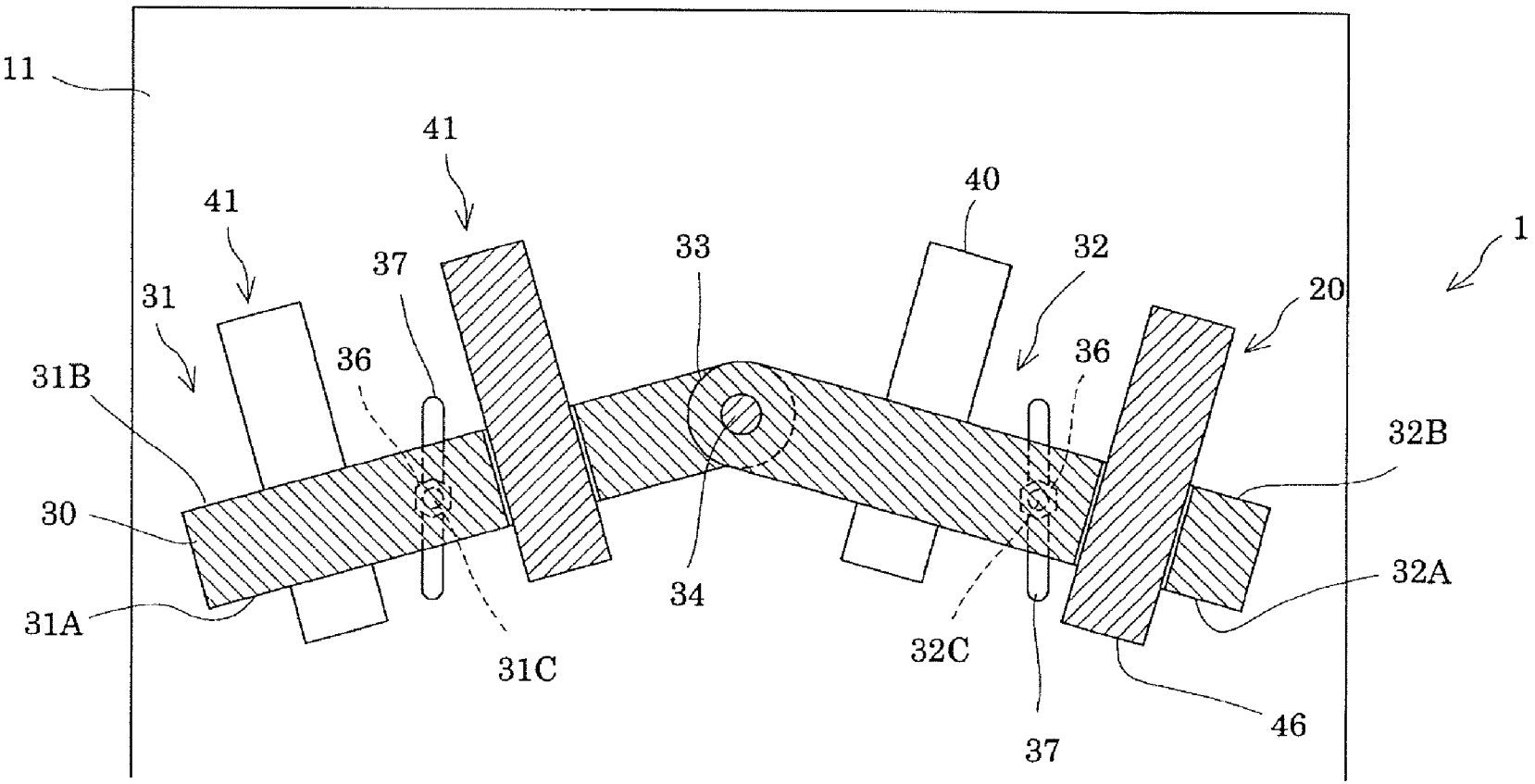
FIG. 6 is a sectional view along line B-B' of FIG. 1.

The liquid ejection head unit 20 will be described in further detail using FIGS. 3 through 6 as well. FIG. 3 is a plan view showing the liquid ejection surface side of the liquid ejection head unit, FIG. 4 is a sectional view along line A-A' of FIG. 3, FIG. 5 is an enlarged side view showing the relevant parts of FIG. 2, and FIG. 6 is a sectional view along line B-B' of FIG. 1.

As shown in FIGS. 1 through 6, the head attachment member 30 has a plurality (two in the present example) of plate-shaped members 31, 32 having attachment surfaces 31A, 32A for the plurality of liquid ejection heads 40, and back surfaces 31B, 32B which are surfaces parallel to the attachment surfaces 31A, 32A, and the end parts of the plate-shaped members 31, 32 are connected so as to be able to rotate via a hinge part 33 which has a rotation shaft 34. As a result, the angle formed by the attachment surfaces 31A, 32A is adjustable.

A plurality of head groups 41 composed of a plurality of liquid ejection heads 40 is fixed to each of the attachment surfaces 31A, 32A. In the present embodiment, two head groups 41 are fixed to each of the attachment surfaces 31A, 32A. A single head group 41 in the present embodiment is configured so that a plurality of liquid ejection heads 40 is aligned along a first direction which is the axial direction of the rotation shaft 12 of the support drum 10, as shown in FIG. 3. One or more nozzle rows 43 in which a plurality of nozzle openings 42 is aligned are provided to the liquid ejection heads 40. The liquid ejection heads 40 of the head groups 41 are arranged so that the nozzle openings 42 of the nozzle rows 43 are aligned in the alignment direction (first direction) of the liquid ejection heads 40.

The two head groups 41 attached to the same attachment surfaces 31A, 32A are aligned in a second direction (rotation direction R of the support drum 10) which intersects with the first direction (axial direction), and the two head groups 41 are arranged in positions which are somewhat offset in the first direction. In other words, the liquid ejection heads 40 of the two head groups 41 fixed to the same attachment surface 31A or 32A are in a staggered arrangement, and the liquid ejection heads 40 of one adjacent head group 41 and the liquid ejection heads 40 of the other head group 41 are arranged so that the nozzle openings 42 at the end of the nozzle rows 43 are the same position relative to each other in the second direction (rotation direction R). The nozzle openings 42 can thereby be provided at the same pitch in the first direction by the plurality of liquid ejection heads 40, and printing can be performed in all regions in the first direction.

The liquid ejection heads 40 are each attached to the attachment surfaces 31A, 32A in the present embodiment by providing a through-hole 35 through the head attachment member 30 in the thickness direction thereof, inserting the side of the liquid ejection head 40 opposite the liquid ejection surface 46 thereof into the through-hole 35 from the side of the attachment surfaces 31A, 32A, placing flange parts 44 which protrude from the sides of the liquid ejection head 40 against the attachment surfaces 31A, 32A, and fixing the flange parts 44 through the use of screw members 45, as shown in FIG. 4. The plurality of liquid ejection heads 40 fixed to the same attachment surfaces 31A, 32A is thereby provided so that liquid ejection surfaces 46 provided with the nozzle openings 42 are at the same height from the attachment surfaces 31A, 32A, and the liquid ejection surfaces 46 are at the same inclination angle as the attachment surfaces 31A, 32A. Mutually adjacent liquid ejection heads 40 and liquid ejection heads 40 which are provided to adjacent attachment surfaces 31A, 32A are fixed to the attachment surfaces 31A, 32A after being aligned with respect to the attachment surfaces 31A, 32A so that a predetermined interval is maintained between the liquid ejection heads 40. This alignment operation will be described hereinafter.

As shown in FIG. 5, the two attachment surfaces 31A, 32A to which the two head groups 41 are fixed are also provided at an angle to each other so that when the head attachment member 30 is positioned with respect to the support drum 10, the two attachment surfaces 31A, 32A are each at a predetermined angle with respect to the support drum 10. Specifically, one attachment surface 31A is disposed so as to be parallel to a tangent line 104 which is tangent to the peripheral surface of the support drum 10 at an intersection point 103 of a line segment 102 which connects the rotational center 101 of the support drum 10 and the center 100 on the attachment surface 30A between mutually adjacent head groups 41. It is thereby possible to equalize the distances between the peripheral surface of the support drum 10 and the liquid ejection surfaces 46 of the liquid ejection heads 40 which constitute adjacent head groups 41. In other words, the distance between the tangent line 104 and the liquid ejection surfaces 46 of the liquid ejection heads 40 of one head group 41 is the same as the distance between the tangent line 104 and the liquid ejection surfaces 46 of the liquid ejection heads 40 of the other head group 41. Consequently, the distance $W_1$ between the surface of the support drum 10 and the liquid ejection surfaces 46 of the liquid ejection heads 40 of one head group 41 is the same as the distance $W_2$ between the surface of the support drum 10 and the liquid ejection surfaces 46 of the liquid ejection heads 40 of the other head group 41. Incidentally, since the distances $W_1$, $W_2$ between the surface of the support drum 10 and the liquid ejection surfaces 46 of the liquid ejection heads 40 are the flight distances traveled by the liquid from the liquid ejection surfaces 46 from ejection thereof to landing on the ejection-receiving medium S, by making the flight distances uniform among the plurality of head groups 41, landing deviation can be suppressed, and printing quality can be enhanced.

FIG. 5 is an extraction of the left half (plate-shaped member 31) of the diagram of the liquid ejection head unit 20, and the right half (plate-shaped member 32) has exactly the same configuration. In other words, the structure has left-right symmetry about the rotation shaft 34.

The center 100 on the attachment surface 31A between mutually adjacent head groups 41 referred to herein is the center (midpoint) in the second direction (rotation direction R) based on the nozzle rows 43 of the two head groups 41. For example, in a case in which only one nozzle row 43 is provided to each liquid ejection head 40, as in the present embodiment, the center 100 is the center between the nozzle rows 43 of the liquid ejection heads 40 adjacent in the rotation direction R. In a case in which two or more nozzle rows 43 are provided to each liquid ejection head 40, for example, the midpoint on the attachment surface 31A between the nozzle rows closest to each other is used as the center 100. The use of liquid ejection heads having different distances between nozzle rows is not preferred, but in a case of using liquid ejection heads in which the distance between nozzle rows differs for each head group, or in a case of using liquid ejection heads having different numbers of nozzle rows for each head group, for example, the center 100 may be the midpoint of the center positions of a plurality of nozzle rows of mutually adjacent liquid ejection heads, based on the center positions of a plurality of nozzle rows in a single liquid ejection head. The distances (flight distances) from the nozzle openings to the surface of the support drum 10 are thereby made as uniform as possible.

The distances $W_1$, $W_2$ between the surface of the support drum 10 and the liquid ejection surfaces 46 of the liquid ejection heads 40 are essentially distances on a line connecting the nozzle openings 42 and the rotational center 101 of the support drum 10. The reason for this is that the liquid ejection surfaces 46 of the liquid ejection heads 40 are attached at the same angle as the attachment surfaces 31A, 32A. In other words, by fixing the liquid ejection heads 40 to the head attachment member 30 so that the liquid ejection surfaces 46 are at the same angle as (parallel to) the attachment surfaces 31A, 32A, and positioning the attachment surfaces 31A, 32A with respect to the support drum 10, the distances between the liquid ejection surfaces 46 of the plurality of liquid ejection heads 40 and the surface of the support drum 10 can be made uniform.

The two attachment surfaces 31A, 32A described above each have the same width in the first direction (axial direction). By thus arranging the attachment surfaces 31A, 32A so that the boundary line 105 thereof is parallel to the axial direction (first direction) of the support drum 10, the two attachment surfaces 31A, 32A can be arranged parallel to the axial direction (first direction) of the surface of the support drum 10.

A configuration may be adopted in which a different type of liquid is fed to each of the attachment surfaces 31A, 32A to the liquid ejection heads 40 fixed to the two attachment surfaces 31A, 32A, and a configuration may also be adopted in which the same type of liquid is fed to the liquid ejection heads 40. For example, in a case in which the same type of liquid is fed to the liquid ejection heads 40 of the two attachment surfaces 31A, 32A, the resolution can be doubled by offsetting the liquid ejection heads 40 of one attachment surface 31A and the liquid ejection heads 40 of the other attachment surface 32A from each other by half the pitch (one-half pitch) of the nozzle openings 42 adjacent to each other in the first direction (axial direction of the rotation shaft 12), for example. In a highly precise positioning such that the nozzle openings 42 are offset by one-half pitch in this arrangement, printing defects occur unless the liquid ejection heads 40 fixed to the two attachment surfaces 31A, 32A are positioned with high precision relative to each other. In the present embodiment, two attachment surfaces 31A, 32A are provided to one head attachment member 30, and the relative positioning of the liquid ejection heads 40 fixed to each of the two attachment surfaces 31A, 32A can be set with high precision on the same member. Therefore, highly precise positioning can easily be performed, whereby the same type of liquid is ejected from the liquid ejection heads 40 fixed to the two attachment surfaces 31A, 32A, and the resolution of the liquid ejection heads 40 is doubled. Incidentally, a configuration in which a plurality of head attachment members having only one attachment surface is prepared, and the head attachment members are positioned with respect to the support drum 10 with high precision so that the nozzle openings 42 are offset by one-half pitch is difficult to achieve, and there is a risk of reduced printing quality. Even in a case in which the same type of liquid is ejected from the liquid ejection heads 40 fixed to the two attachment surfaces 31A, 32A, the liquid ejection heads 40 of the attachment surfaces 31A, 32A may be provided in the same positions in the second direction rather than being offset by one-half the pitch of the nozzle openings 42 in the first direction. In this case, although the resolution is not doubled, high-speed printing is possible.

The angle formed by the plate-shaped members 31, 32 is appropriately adjusted as described above, and the head attachment member 30 is fixed to the frame 11 via the rotation shaft 34, but the plate-shaped members 31, 32 are retained at the predetermined angle by a locking mechanism. The configuration of the locking mechanism is not particularly limited, but a locking mechanism such as the one shown in FIG. 6, for example, is preferred. FIG. 6 is a sectional view along line B-B' of FIG. 1. As shown in FIG. 6, two elongated holes 37 extending in the vertical direction are provided to the frame 11, and bolts 36 can pass through the frame 11 from the back side thereof. Female thread parts 31C, 32C which screw together with the distal end parts of the bolts 36 are formed in the end surfaces of the plate-shaped members 31, 32 on the frame 11 side thereof. Consequently, the angle formed by the attachment surfaces 31A, 32A can be locked by screwing the bolts 36 into the female thread parts 31C, 32C from the back side of the frame 11 and tightening the bolts 36 in a state in which the attachment surfaces 31A, 32A are adjusted to the predetermined angle. By making elongated holes 37 for insertion of the bolts 36, the height position of the bolts 36, i.e., the angle of the attachment surfaces 31A, 32A, can be finely adjusted.

Figure 7A:
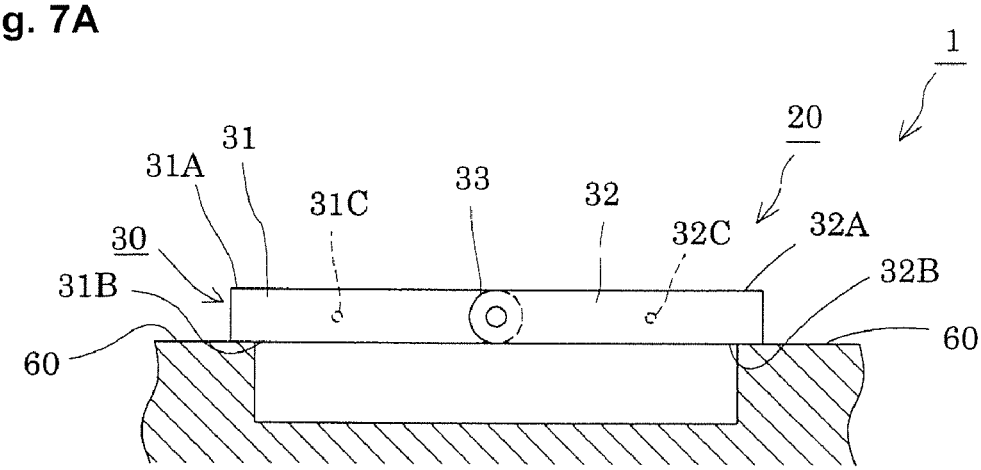
FIGS. 7A to 7C are views showing the method for attaching the head attachment member according to an embodiment.

The description in the above embodiment assumes completion of alignment of the liquid ejection heads 40 with respect to the attachment surfaces 31A, 32A, but the head attachment method including the alignment process will be described hereinafter based on FIGS. 7A to 7C. First, as shown in FIG. 7A, adjustment is performed so that the attachment surfaces 31A, 32A are horizontal by rotating the plate-shaped members 31, 32 about the rotational center of the hinge part 33, and in this state, the back surfaces 31B, 32B are brought into contact with a horizontal surface 60 of a reference stage and retained. The attachment surfaces 31A, 32A form a horizontal surface in this state.

Figure 7B:
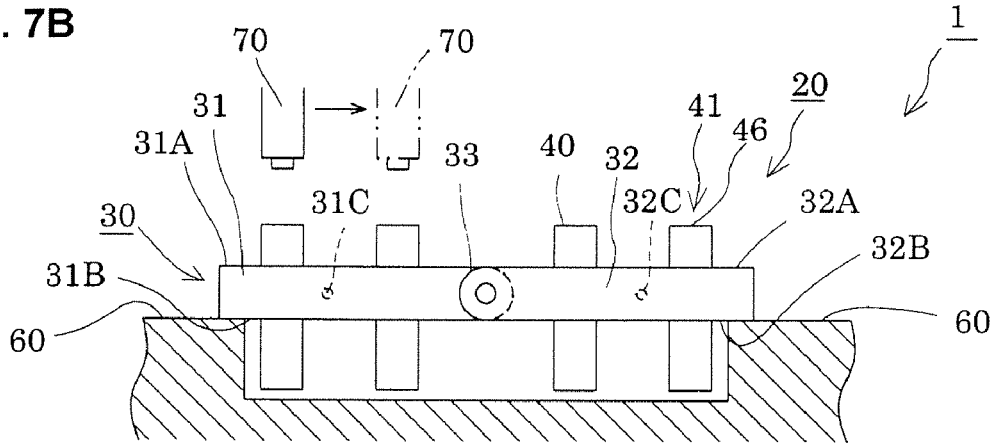

The liquid ejection heads 40 are then placed/fixed while being aligned with respect to the attachment surfaces 31A, 32A, while an imaging camera 70 of an alignment device is moved horizontally above the head attachment member 30, as shown in FIG. 7B. In this alignment process, the imaging camera 70 need only be moved in the horizontal plane, and movement in the vertical direction is unnecessary. Movement error can therefore be reduced by a corresponding degree, and highly precise alignment can easily be performed.

Figure 7C:
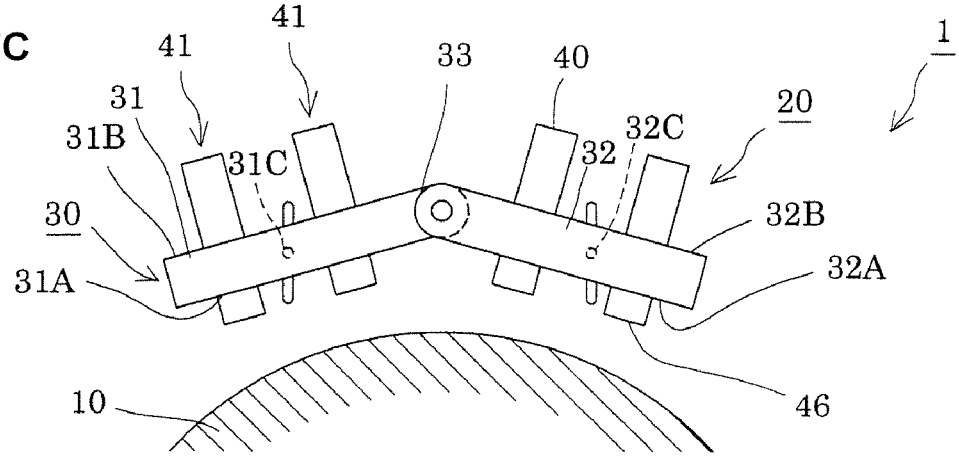

Lastly, the angle formed by the attachment surfaces 31A, 32A of the head attachment member 30 integrated with the liquid ejection heads 40 as the liquid ejection head unit 20 is adjusted to the predetermined angle, according to an arrangement such as the one described based on FIG. 5, and the angle is fixed with respect to the support drum 10, as shown in FIG. 7C.

An embodiment of the present invention is described above, but the basic structure of the present invention is not limited by the embodiment described above.

For example, in the embodiment described above, two attachment surfaces 31A, 32A are provided to a single head attachment member 30, and two head groups 41 are attached to each of the attachment surfaces 31A, 32A. However, the number of attachment surfaces 31A, 32A is not particularly limited, and three or more attachment surfaces may also be provided.

In the embodiment described above, two head groups 41 are fixed to a single attachment surface 31A or 32A, but this configuration is not particularly limiting. For example, four head groups 41 may be provided to a single attachment surface 31A or 32A. In this case, since a plurality of liquid ejection heads 40 in the staggered arrangement shown in FIG. 3 can essentially be considered to constitute a single head group, two head groups in a staggered arrangement are then considered to be provided to a single attachment surface 31A or 32A. Consequently, the planar direction of the attachment surfaces 31A, 32A is preferably disposed parallel to the tangent line which is tangent to the peripheral surface of the drum at an intersection point of a line segment which connects the center of the support drum 10 and the center (midpoint) on the attachment surfaces 31A, 32A of the two head groups. The distances between the support drum 10 and the liquid ejection surfaces 46 of the liquid ejection heads 40 can thereby be made uniform between the two head groups, and printing quality can be enhanced.

In the embodiment described above, a single liquid ejection head unit 20 (head attachment member 30) is provided to the liquid ejection device 1, but this configuration is not particularly limiting, and two or more liquid ejection head units 20 may be provided, for example. In this case, the liquid ejection head unit 20 may be disposed higher or lower in the vertical direction of the support drum 10, or to the left or right in the horizontal direction, and the flat surface may also be disposed at a 45-degree or other angle with respect to the vertical direction.

In the embodiment described above, a so-called line-type liquid ejection device 1 is described in which the liquid ejection head unit is fixed, and printing is applied to the ejection-receiving medium S merely by rotating the support drum 10, but this configuration is not particularly limiting, and the present invention can also be applied to a so-called serial-type liquid ejection device in which printing is applied while the liquid ejection head unit 20 is moved in the axial direction of the rotation shaft 12 of the support drum 10.

The present invention is applicable to liquid ejection heads in general, and can be applied to various types of inkjet recording heads and other recording heads used in printers and other image recording devices, color material ejection heads used to manufacture color filters for liquid crystal displays and the like, electrode material ejection heads used to form electrodes for organic EL displays, FEDs (Field Emission Displays), and the like, biological organic ejection heads used to manufacture bio chips, and other liquid ejection heads, for example.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A head attachment member in which a plurality of liquid ejection heads is attached, the head attachment member being disposed so as to face a support drum for supporting an ejection-receiving medium and rotating about a shaft, the head attachment member comprising:

a pair of plate-shaped members each having an attachment surface to which a plurality of head groups each including the liquid ejection heads is attached and a back surface extending parallel to the attachment surface, end parts of the plate-shaped members being connected to each other so as to be able to rotate about a hinge part so that an angle formed by the attachment surfaces is adjustable.

2. The head attachment member according to claim 1, further comprising a locking mechanism configured to lock the angle between the attachment surfaces at an angle at which each of the attachment surfaces is parallel to a line tangent to a peripheral surface of the support drum at an intersection point of the peripheral surface of the support drum with a line segment formed by connecting a center of the support drum and a center between the head groups adjacent in a rotation direction of the support drum and attached to the plate-shaped member.

3. A liquid ejection device comprising:

the head attachment member according to claim 2;

the liquid ejection heads attached to each of the attachment surfaces of the head attachment member; and the support drum configured to support the ejection-receiving medium.

4. The liquid ejection device according to claim 3, wherein the liquid ejection heads for ejecting the same type of liquid are attached to each of the attachment surfaces.

5. A liquid ejection device comprising:

the head attachment member according to claim 1;

the liquid ejection heads attached to each of the attachment surfaces of the head attachment member; and the support drum configured to support the ejection-receiving medium.

6. The liquid ejection device according to claim 5, wherein the liquid ejection heads for ejecting the same type of liquid are attached to each of the attachment surfaces.

7. A head attachment method for placing a head attachment member, to which a plurality of liquid ejection heads is attached, with respect to a support drum for supporting an ejection-receiving medium and rotating about a shaft, the head attachment member including a pair of plate-shaped members each having an attachment surface to which a plurality of head groups each including the liquid ejection heads is attached and a back surface extending parallel to the attachment surface with end parts of the plate-shaped members being connected to each other so as to be able to rotate about a hinge part so that an angle formed by the attachment surfaces is adjustable, the head attachment method comprising:

retaining the head attachment member so that the back surfaces are in contact with a horizontal surface and the attachment surfaces are horizontal;

placing/fixing the liquid ejection heads in alignment with respect to the head attachment member while moving an imaging unit of an alignment device horizontally above the head attachment member; and rotating the plate-shaped members about the hinge part and adjusting the angle formed by the attachment surfaces so that each of the attachment surfaces is parallel to a line tangent to a peripheral surface of the support drum at an intersection point of the peripheral surface of the support drum with a line segment formed by connecting a center of the support drum and a center between the head groups adjacent in the rotation direction of the support drum attached to the plate-shaped member, and subsequently fixing the head attachment member with respect to the support drum.

* * * * *